US009262962B2

(12) United States Patent
Kim et al.

(10) Patent No.: US 9,262,962 B2
(45) Date of Patent: Feb. 16, 2016

(54) PIXEL AND ORGANIC LIGHT EMITTING DISPLAY DEVICE USING THE SAME

(71) Applicants: Yong-Jae Kim, Yongin (KR); Yong-Sung Park, Yongin (KR)

(72) Inventors: Yong-Jae Kim, Yongin (KR); Yong-Sung Park, Yongin (KR)

(73) Assignee: SAMSUNG DISPLAY CO., LTD., Yongin, Gyunggi-Do (KR)

( * ) Notice: Subject to any disclaimer, the term of this patent is extended or adjusted under 35 U.S.C. 154(b) by 492 days.

(21) Appl. No.: 13/651,788

(22) Filed: Oct. 15, 2012

(65) Prior Publication Data

US 2013/0321376 A1 Dec. 5, 2013

(30) Foreign Application Priority Data

Jun. 1, 2012 (KR) ..... 10-2012-0059119

(51) Int. Cl.
*G09G 5/00* (2006.01)
*G09G 3/32* (2006.01)

(52) U.S. Cl.
CPC ..... *G09G 3/3233* (2013.01); *G09G 2300/0465* (2013.01); *G09G 2300/0819* (2013.01); *G09G 2300/0852* (2013.01); *G09G 2300/0866* (2013.01); *G09G 2310/0216* (2013.01); *G09G 2310/0262* (2013.01)

(58) Field of Classification Search
CPC . G09G 3/3208; G09G 3/3216; G09G 3/3225; G09G 3/3233; G09G 3/3283; G09G 3/3291; G09G 2300/043
USPC ..... 345/76–82, 212
See application file for complete search history.

(56) References Cited

U.S. PATENT DOCUMENTS 8,384,632 B2 * 2/2013 Chiou ..... 345/82
2011/0025677 A1 * 2/2011 Park et al. ..... 345/212

FOREIGN PATENT DOCUMENTS

KR 10-2011-0032251 A 3/2011
KR 10-1040806 B1 6/2011

* cited by examiner

*Primary Examiner* — Alexander Eisen
*Assistant Examiner* — Amit Chatly
(74) *Attorney, Agent, or Firm* — Lee & Morse, P.C.

(57) ABSTRACT

A pixel and an organic light emitting display device using the same, which can improve display quality, are provided. An organic light emitting display device includes pixels, an emission control line, an initial power supply unit, a scan driver and a data driver. The pixels are at intersection portions of scan lines and data lines. The emission control line is commonly coupled to the pixels. The initial power supply unit is commonly coupled to gate electrodes of one or more transistors included in each of the pixels, and supplies a first voltage during a first period, a second voltage lower than the first voltage during a second period, and a third voltage higher than the first voltage during a third period in one frame period. The scan driver drives the scan lines and the emission control line. The data driver drives the data lines.

26 Claims, 4 Drawing Sheets

PIXEL AND ORGANIC LIGHT EMITTING DISPLAY DEVICE USING THE SAME

CROSS-REFERENCE TO RELATED APPLICATIONS

This application claims priority under 35 U.S.C. §119 to and the benefit of Korean Patent Application No. 10-2012-0059119, filed on Jun. 1, 2012, in the Korean Intellectual Property Office, the entire content of which is incorporated herein by reference.

BACKGROUND

1. Field

Embodiments relate to a pixel and an organic light emitting display device using the same, and more particularly, to a pixel and an organic light emitting display device using the same, which can improve display quality.

2. Description of the Related Art

Flat panel display devices, including a liquid crystal display, a field emission display, a plasma display panel, an organic light emitting display device, and the like, have been developed. Among these flat panel display devices, the organic light emitting display displays images using organic light emitting diodes that emit light through recombination of electrons and holes. The organic light emitting display has a fast response speed and low power consumption.

An organic light emitting display device has a plurality of pixels arranged in a matrix form at intersection portions of a plurality of data lines, a plurality of scan lines and a plurality of power lines. Each of the pixels generally includes an organic light emitting diode, two or more transistors including a driving transistor, and one or more capacitors.

Practically, it is impossible in the current fabrication process to fabricate the organic light emitting display device so that all transistors of the organic light emitting display device have the same characteristics. Accordingly, the variation in the threshold voltage of the driving transistor occurs.

SUMMARY

Embodiments provide a pixel and an organic light emitting display device using the same, which can improve display quality.

According to embodiments, there is provided an organic light emitting display device, including: pixels positioned at intersection portions of scan lines and data lines; an emission control line commonly coupled to the pixels; an initial power supply unit commonly coupled to gate electrodes of one or more transistors included in each of the pixels, for supplying a first voltage during a first period, a second voltage lower than the first voltage during a second period, and a third voltage higher than the first voltage during a third period in one frame period; a scan driver for driving the scan lines and the emission control line; and a data driver for driving the data lines.

The first voltage may be set to a voltage at which the transistor included in the pixel is turned off, and the second voltage may be set to a voltage at which the transistor included in the pixel is turned on. The scan driver may sequentially supply a scan signal to the scan lines during the first period and simultaneously supplies a scan signal to the scan lines during the third period. The scan driver may supply an emission control signal to the emission control line during the second and third periods except the first period. The scan signal supplied during the third period may be set to have a width wider than that of the scan signal supplied during the first period. The scan signal supplied during the first period may be set to have a width of 2 H or more.

The scan signal may be set to the voltage at which the transistor included in the pixel is turned on, and the emission control signal may be set to the voltage at which the transistor included in the pixel is turned off. The scan driver. The data driver may supply a scan signal supplied to an i-th (the i is a natural number) scan line and a scan signal supplied to an (i+1)-th scan line during the first period so that the scan signals overlap each other during a portion of the first period. The data driver may supply, to the data lines, a data signal corresponding to the scan signal supplied to the i-th scan line during the period in which the scan signal supplied to the i-th scan line and the scan signal supplied to the (i+1)-th scan line overlap each other. The data driver may supply, to the data lines, the lowest voltage that the data driver is to supply during the second period.

Each of the pixels positioned on an i-th (the i is a natural number) horizontal line may include an organic light emitting diode; a second transistor coupled between a data line and a first node, for controlling the coupling between the data line and the first node, corresponding to a scan signal supplied to a current scan line and an emission control signal supplied to the emission control line; a third transistor coupled between the first node and a second node, for controlling the coupling between the first and second nodes, corresponding to the scan signal supplied to the current scan line and a scan signal supplied to a next scan line; a second capacitor coupled between a third node and a first power; a first transistor coupled between the second node and a fourth node, and having a gate electrode coupled to the third node so as to control the amount of current supplied to the organic light emitting diode; a fourth transistor coupled between the third and fourth nodes, and simultaneously turned on/off together with the third transistor; and a first capacitor having one terminal coupled to the first node.

The first capacitor may be formed to have a capacitance higher than that of the second capacitor. The current scan line may be an i-th scan line, and the next scan line may be an (i+2+$\alpha$)-th (the $\alpha$ is 0, 1, 2, 3, . . . ) scan line. The other terminal of the first capacitor may be coupled to the initial power supply unit. The other terminal of the first capacitor may be coupled to a static voltage source. The second transistor may be formed with two transistors coupled in series to each other. A gate electrode of the primary second transistor may be coupled to the current scan line, and a gate electrode of the secondary second transistor may be coupled to the emission control line. The third transistor may be formed with two transistors coupled in series to each other. A gate electrode of the primary third transistor may be coupled to the current scan line, and a gate electrode of the secondary third transistor may be coupled to the next scan line. The fourth transistor may be formed with two transistors coupled in series to each other. A gate electrode of the primary fourth transistor may be coupled to the current scan line, and a gate electrode of the secondary fourth transistor may be coupled to the next scan line.

Each of the pixels positioned on the i-th horizontal line further may include a fifth transistor coupled between the second node and the first power, for controlling the coupling between the second node and the first power, corresponding to initial power supplied from the initial power supply unit and the emission control signal supplied to the emission control line; and a sixth transistor coupled between the fourth node and an anode electrode of the organic light emitting diode, and having a gate electrode coupled to the emission control line. The fifth transistor may be formed with two transistors coupled in parallel to each other. A gate electrode of the primary fifth transistor may be coupled to the emission control line, and a gate electrode of the secondary fifth transistor may be coupled to the initial power supply unit. Each of the pixels positioned on the i-th horizontal line may further include a seventh transistor coupled between the third node and the data line, and having a gate electrode coupled to the initial power supply unit.

Each of the pixels positioned on the i-th horizontal line may further include a seventh transistor coupled between the third node and the static voltage source, and having a gate electrode coupled to the initial power supply unit. The static voltage source may be set to have a voltage lower than the data signal supplied to the data lines.

According to embodiments, there is provided a pixel including: an organic light emitting diode; a second transistor having two transistors coupled in series between a data line and a first node, wherein gate electrodes of the two transistors are coupled to a current scan line and an emission control line, respectively; a third transistor having two transistors coupled in series between the first node and a second node, wherein gate electrodes of the two transistors are coupled to the current scan line and a next scan line, respectively; a second capacitor coupled between a third node and a first power; a first transistor coupled between the second node and a fourth node, and having a gate electrode coupled to the third node so as to control the amount of current supplied to the organic light emitting diode; a fourth transistor having two transistors coupled in series between the third and fourth nodes, wherein gate electrodes of the two transistors are coupled to the current scan line and the next scan line, respectively; and a first capacitor coupled between the first node and initial power.

The pixel may further include a fifth transistor having two transistors coupled in parallel between the second node and the first power, wherein gate electrodes of the two transistors are coupled to the emission control line and the initial power; a sixth transistor coupled between the fourth node and an anode electrode of the organic light emitting diode, and having a gate electrode coupled to the emission control line; and a seventh transistor coupled between the third node and the data line, and having a gate electrode coupled to the initial power. The pixel may further include a fifth transistor having two transistors coupled in parallel between the second node and the first power, wherein gate electrodes of the two transistors are coupled to the emission control line and the initial power; a sixth transistor coupled between the fourth node and the anode electrode of the organic light emitting diode, and having a gate electrode coupled to the emission control line; and a seventh transistor coupled between the third node and a static voltage source, and having a gate electrode coupled to the initial power. The static voltage source may be set to having a voltage lower than that of the data signal supplied to the data line.

DETAILED DESCRIPTION

Figure 1:
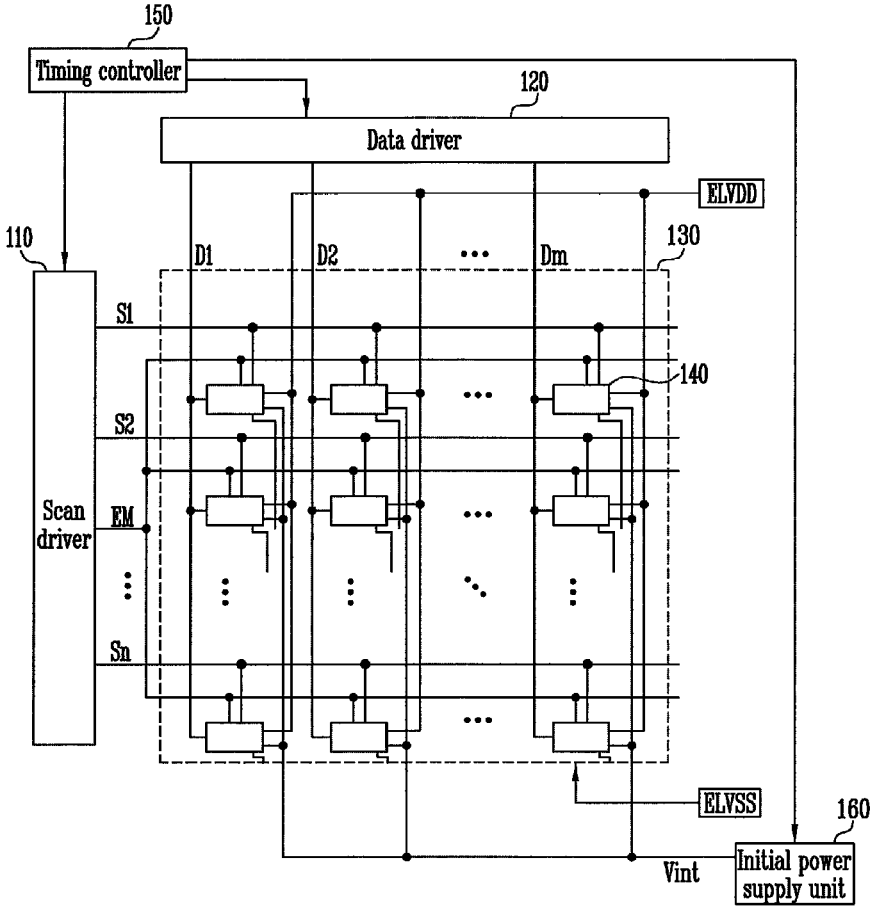
FIG. 1 is a diagram illustrating an organic light emitting display device according to an embodiment.

Hereinafter, certain exemplary embodiments according will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the detailed description are omitted for clarity. Also, like reference numerals refer to like elements throughout.

FIG. 1 is a diagram illustrating an organic light emitting display device according to an embodiment. Although only first to n-th scan lines S1 to Sn are shown in FIG. 1, at least two scan lines Sn+1 and Sn+2 may be additionally formed corresponding to the structure of a pixel 140.

Referring to FIG. 1, the organic light emitting display device according to this embodiment includes pixels 140 positioned at intersections of scan lines S1 to Sn and data lines D1 to Dm, a pixel unit 130 having the pixels 140 arranged in a matrix form, a scan driver 110 for driving the scan lines S1 to Sn and an emission control line EM, a data driver 120 for supplying a data signal to the data lines D1 to Dm, an initial power supply unit 160 for supplying initial power Vinit to the pixels 140, and a timing controller 150 for controlling the scan driver 110, the data driver 120, and the initial power supply unit 160.

The scan driver 110 sequentially or simultaneously supplies a scan signal to the scan line S1 to Sn. Practically, the scan driver 110 sequentially supplies the scan signal to the scan lines S1 to Sn during a first period in a frame, and simultaneously supplies the scan signal to the scan lines S1 to Sn during a third period in the frame.

The scan driver 110 supplies scan signals respectively to an i-th (the i is a natural number) scan line Si and an (i+1)-th scan line Si+1 so that the scan signals overlap each other during a portion of the first period. For example, the scan signal may have a period of 2 H, and the scan signals respectively supplied to the i-th scan line Si and the (i+1)-th scan line Si+2 may overlap each other during a period of 1 H The scan driver 110 simultaneously supplies a scan signal having a period of 2 H or more, i.e., a scan signal having a width greater than that of the scan signal supplied during the first period, to the scan lines S1 to Sn during the third period. Here, the third period is a period in which the threshold voltage of a driving transistor is compensated. If the scan signal is supplied during a period of 2 H or more, the threshold voltage of the driving transistor can be stably compensated.

The emission control line EM is commonly coupled to the pixels 140. The scan driver 110 supplies an emission control signal during the second and third periods in the frame, and does not supply the emission control signal during the first period in the frame. When the emission control signal is supplied, the transistor coupled to the emission control line EM is turned off. When the emission control signal is not supplied, the transistor coupled to the emission control line EM is turned on. Meanwhile, although it has been illustrated in FIG. 1 that the emission control line EM is coupled to the scan driver 110 for convenience of illustration, the present embodiment is not limited thereto. For example, the emission control line EM may receive an emission control signal supplied from a separate driver (not shown).

The data driver 120 supplies a data signal to the data lines D1 to Dm in synchronization with the scan signal supplied to the scan lines S1 to Sn during the first period. Here, the data driver 120 supplies a data signal corresponding to the i-th scan line S1 to the data lines D1 to Dm during the period in which the scan signals respectively supplied to the i-th scan line Si and the (i+1)-th scan line Si+1 overlap each other. The data driver 120 supplies, to the data lines D1 to Dm, the lowest voltage that the data driver 120 can supply during the second period.

The timing controller 150 controls the scan driver 110, the data driver 120 and the initial power supply unit 160, corresponding to a synchronization signal supplied from an outside thereof.

The pixel unit 130 has the pixels 140 formed at the intersection portions of the scan lines S1 to Sn and the data lines D1 to Dm. The pixel 140 is coupled to a current scan line, a next scan line, a data line and the initial power supply unit 160. Here, each of the pixels 140 positioned on an i-th scan line is coupled to an i-th scan line (i.e., a current scan line) and an (i+2)-th scan line (i.e., a next scan line). The pixels 140 controls the amount of current flowing in second power ELVSS via an organic light emitting diode (not shown) from first power ELVDD.

The initial power supply unit 160 supplies the initial power Vinit to the pixels 140. Practically, the initial power supply unit 160 supplies initial power Vinit of a first voltage V1 during the first period, and supplies initial power Vinit of a second voltage V2 lower than the first voltage V1 during the second period. The initial power supply unit 160 supplies initial power Vinit of a third voltage V3 higher than the first voltage V1 during the third period. Here, the first voltage V1 may be a voltage at which the transistor receiving the initial power Vinit can be turned off, and the second voltage V2 may be a voltage at which the transistor receiving the initial power Vinit can be turned on.

Figure 2:
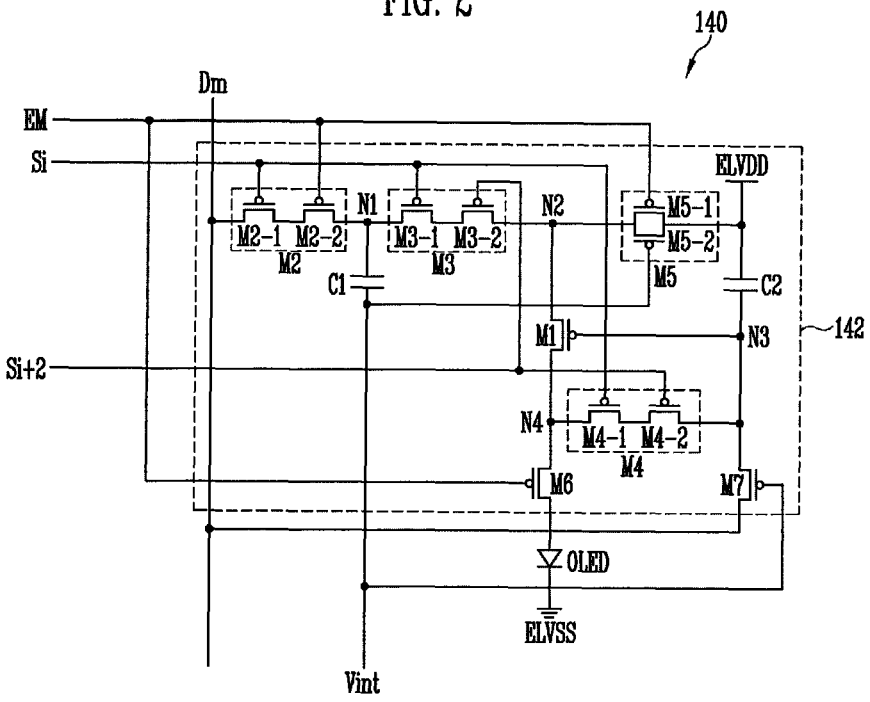
FIG. 2 is a circuit diagram illustrating a first embodiment of a pixel shown in FIG. 1.

FIG. 2 is a circuit diagram illustrating a first embodiment of a pixel shown in FIG. 1. For convenience of illustration, a pixel positioned on an i-th horizontal line and coupled to an m-th data line Dm is shown in FIG. 2.

Referring to FIG. 2, the pixel 140 according to this embodiment includes an organic light emitting diode OLED and a pixel circuit 142 coupled to a data line Dm, scan lines Si, and Si+2 and an emission control line EM so as to control the amount of current supplied to the organic light emitting diode OLED.

An anode electrode of the organic light emitting diode OLED is coupled to the pixel circuit 142, and a cathode electrode of the organic light emitting diode OLED is coupled to the second power ELVSS. Here, the voltage of the second power ELVSS is set to a voltage lower than that of the first power ELVDD. The organic light emitting diode OLED generates light with a predetermined luminance, corresponding to the amount of current supplied from the pixel circuit 142.

The pixel circuit 142 controls the amount of current supplied to the organic light emitting diode OLED. To this end, the pixel circuit 142 includes first to seventh transistors M1 to M7, a first capacitor C1, and a second capacitor C2.

The second transistor M2 is formed by coupling two transistors M2-1 and M2-2 in series to each other. The second transistor M2 is formed into a dual gate structure, and accordingly, the mounting area of the second transistor M2 is set similarly to that when one transistor is formed. The second transistor M2 is coupled between the data line Dm and a first node N1. A gate electrode of a primary second transistor M2-1 is coupled to the current scan line Si, and a gate electrode of a secondary second transistor M2-2 is coupled to the emission control line EM. The second transistor M2 electrically couples the data line Dm and the first node N1 to each other during the period in which a scan signal is supplied to the current scan line S1, and simultaneously, an emission control signal is not supplied to the emission control line EM.

The third transistor M3 has a dual gate structure, and is formed by coupling two transistors M3-1 and M3-2 in series to each other. The third transistor M3 is coupled between the first node N1 and a second node N2. A gate electrode of a primary third transistor M3-1 is coupled to the current scan line Si, and a gate electrode of a secondary third transistor M3-2 is coupled to the next scan line Si+2. The third transistor M3 electrically couples the first and second nodes N1 and N2 to each other during the period in which the scan signal is supplied to the current scan line Si and the next scan line Si+2.

A first electrode (e.g., a source electrode) of the first transistor M1 (driving transistor) is coupled to the second node N2, and a second electrode (e.g., a drain electrode) of the first transistor M1 is coupled to a fourth node N4. A gate electrode of the first transistor M1 is coupled to a third node N3. The first transistor M1 supplies, to the organic light emitting diode OLED, a voltage applied to the third node N3, i.e., current corresponding to the voltage charged into the second capacitor C2.

The fourth transistor M4 has a dual gate structure, and is formed by coupling two transistors M4-1 and M4-2 in series to each other. The fourth transistor M4 is coupled between the third and fourth nodes N3 and N4. A gate electrode of a primary fourth transistor M4-1 is coupled to the current scan line Si, and a gate electrode of a secondary fourth transistor M4-2 is coupled to the next scan line Si+2. The fourth transistor M4 electrically couples the third and fourth nodes N3 and N4 to each other during the period in which the scan signal is supplied to the current scan line Si and the next scan line Si+2. If the third and fourth nodes N3 and N4 are electrically coupled to each other, the first transistor M1 is diode-coupled.

The fifth transistor M5 is formed by coupling two transistors M5-1 and M5-2 in parallel to each other. The fifth transistor M5 is coupled between the first power ELVDD and the second node N2. A gate electrode of a primary fifth transistor M5-1 is coupled to the emission control line EM, and a gate electrode of a secondary fifth transistor M5-2 is coupled to the initial power supply unit 160. The fifth transistor M5 supplies the voltage of the first power ELVDD to the second node N2 during the period in which the emission control signal is not supplied, and simultaneously, the initial power Vinit of the second voltage V2 is supplied.

A first electrode of the sixth transistor M6 is coupled to the fourth node, and a second electrode of the sixth transistor M6 is coupled to the anode electrode of the organic light emitting diode OLED. A gate electrode of the sixth transistor M6 is coupled to the emission control line EM. The sixth transistor M6 is turned on during the period in which the emission control signal is not supplied, so that the fourth node N4 and the anode electrode of the organic light emitting diode OLED are electrically coupled to each other.

A first electrode of the seventh transistor M7 is coupled to the third node N3, and a second electrode of the seventh transistor M7 is coupled to the data line Dm. A gate electrode of the seventh transistor M7 is coupled to the initial power supply unit 160. The seventh transistor M7 is turned on during the period in which the initial power Vinit of the second voltage V2, so that the data line Dm and the third node N3 are electrically coupled to each other.

The first capacitor C1 is coupled between the first node N1 and the initial power supply unit 160. The first capacitor C1 charges a voltage corresponding to the data signal during the period in which the second transistor M2 is turned on.

The second capacitor C2 is coupled between the first power ELVDD and the third node N3. The second capacitor C2 charges the data signal and a voltage corresponding to the threshold voltage of the first transistor M1 during the period in which the third and fourth transistors M3 and M4 are turned on. Here, the second capacitor C2 is charged by receiving the voltage charged in the first capacitor C1. To this end, the first capacitor C1 has a capacitance higher than that of the second capacitor C2.

Figure 3:
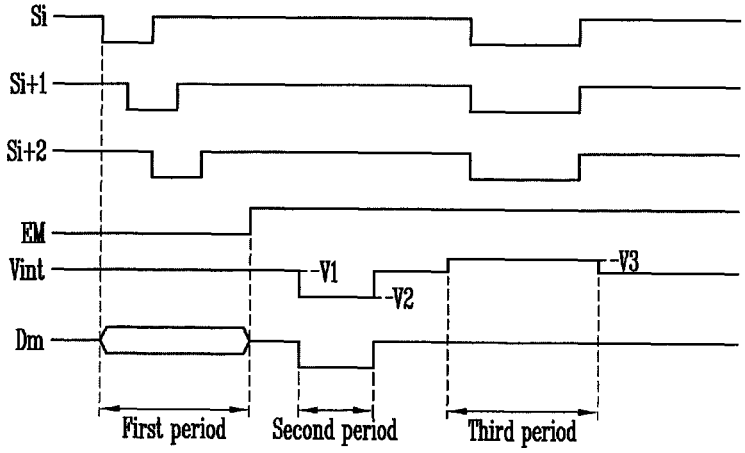
FIG. 3 is a waveform diagram illustrating an embodiment of a driving method of the pixel shown in FIG. 2.

FIG. 3 is a waveform diagram illustrating an embodiment of a driving method of the pixel shown in FIG. 2. For convenience of illustration, only scan signals supplied to three scan lines Si to Si+2 are shown in FIG. 3.

Referring to FIG. 3, the one frame according to this embodiment is divided first, second and third periods. The first period is a period in which the data signal is charged in the first capacitor C1, and simultaneously, the organic light emitting diode OLED emits light corresponding to the voltage charged in the second capacitor C2. The second period is a period in which the gate electrode (i.e., the third node N3) of the first transistor M1 is initialized. The third period is a period in which the second capacitor C2 is charged using the voltage charged in the first capacitor C1.

During the first period, the scan signal is sequentially supplied to the scan lines S1 to Sn, and simultaneously, the data signal is supplied to the data line Dm. The emission control signal is not supplied to the emission control line EM during the first period.

If the emission control signal is not supplied to the emission control line EM, the secondary second transistor M2-2, the primary fifth transistor M5-1, and the sixth transistor M6 are turned on. If the primary fifth transistor M5-1 is turned on, the voltage of the first power ELVDD is supplied to the second node N2. If the sixth transistor M6 is turned on, the fourth node N4 and the organic light emitting diode OLED are electrically coupled to each other. In this case, the first transistor M1 controls the amount of current flowing in the organic light emitting diode OLED from the first power ELVDD, corresponding to the voltage charged in the second capacitor C2, and the light with the predetermined luminance is generated in the organic light emitting diode OLED, corresponding to the amount of the current.

If the scan signal is sequentially supplied to the scan lines S1 to Sn, the primary second transistors M2-1 respectively positioned in the pixels 140 for each horizontal line are sequentially turned on. In other words, if the scan signal is supplied to the i-th scan line Si, the primary second transistor M2-1 positioned on the i-th horizontal line is turned on, and accordingly, the data signal supplied from the data line Dm is stored in the first capacitor C1. Practically, a voltage corresponding to the difference between the first voltage V1 of the initial power Vinit and the voltage of the data signal is charged in the first capacitor C1.

Meanwhile, the primary second transistor M2-1 included in each of the pixels 140 positioned on an (i+1)-th horizontal line is turned on, corresponding to the scan signal supplied the (i+1)-th scan line Si+1 during the period in which the data signal is supplied to the pixels 140 positioned on the i-th horizontal line. In this case, the pixels 140 positioned on the (i+1)-th horizontal line are previously charged by the data signal corresponding to the i-th horizontal line, and accordingly, the data signal corresponding to the (i+1)-th horizontal line can be stably charged. In other words, the voltage of the data signal for each horizontal line is similarly set, and accordingly, if the pixels on the current horizontal line are previously charged, the voltage of a subsequently supplied data signal can be stably charged. If the scan signal is supplied to the (i+1)-th scan line Si+1 is supplied to overlap with the scan line supplied to the i-th scan line Si during a partial period, a desired data signal can be stably charged, regardless of the response speed (or drop speed) of the scan signal supplied to the (i+1)-th scan line Si+1.

After the voltage of the data signal is charged in the first capacitor C1 during the first period, the initial power Vinit of the second voltage V2 is supplied, and simultaneously, a predetermined voltage is supplied to the data line Dm, during the second period.

If the initial power Vinit of the second voltage V2 is supplied, the seventh transistor M7 is turned on. If the seventh transistor M7 is turned on, the voltage of the third node N3 is initialized corresponding to the predetermined voltage supplied to the data line Dm. To this end, the predetermined voltage may be the lowest voltage (e.g., a voltage lower than the gray level of white) that the data driver 120 can supply. Practically, the data driver 120 supplies various voltages, corresponding to the gray levels of white and black. To secure a voltage margin, the data driver 120 is designed to supply a voltage lower than the gray level of white and a voltage higher than the gray level of black.

Meanwhile, since the second and third transistors M2 and M3 are set to be in a turn-off state during the second period, the first capacitor C1 maintains the voltage charged during the first period, regardless of the change in the voltage of the initial power Vinit.

After the voltage of the third node N3 is initialized during the second period, the scan signal is simultaneously supplied to the scan lines S1 to Sn, and simultaneously, the third voltage V3 is supplied to the initial power Vinit, during the third period.

If the scan signal is simultaneously supplied to the scan lines S1 to Sn, the third and fourth transistors M3 and M4 included in each of the pixels 140 are turned on. If the third and fourth transistors M3 and M4 are turned on, the voltage charged in the first capacitor C1 is supplied to the second capacitor C2 via the diode-coupled first transistor M1. The second capacitor C2 charges the data signal and a voltage corresponding to the threshold voltage of the first transistor M1 during the period in which the scan signal is supplied.

Meanwhile, the width of the scan signal during the third period is experimentally determined so that the threshold voltage of the first transistor M1 can be stably compensated. For example, the scan signal during the third period may be set to have a width of 2 H or more.

The voltage of the initial power Vinit during the third period may be the third voltage V3 higher than the first voltage V1. In this case, the voltage of the first capacitor C1 is increased as a voltage higher than the voltage charged during the first period, and accordingly, a desired voltage can be stably charged in the second capacitor C2.

Specifically, the voltage charged in the first capacitor C1 is charged in the second capacitor C2 by charge sharing. The capacitance of the first capacitor C1 may be much greater (e.g., 5 times or more) than that of the second capacitor C2 so that a desired voltage, e.g., a voltage corresponding to the gray level of black is charged in the second capacitor C2. However, in the present embodiment, if the voltage charged in the first capacitor C1 is increased using the initial power Vinit, it is possible to compensate for a voltage lost by the charge sharing, and accordingly, a desired voltage can be stably charged in the second capacitor C2. When the voltage charged in the first capacitor C1 is increased using the initial power Vinit according to this embodiment, the capacitance of the first capacitor C1 may be only somewhat greater (e.g., two times) than that of the second capacitor C2. As described above, the pixel according to this embodiment generates light with the predetermined luminance by repeating the first to third periods as shown in FIG. 3.

Meanwhile, since the pixel 140 according to this embodiment is controlled by the scan lines Si and Si+2, the emission control line Em, and the line for supplying the initial power Vinit, i.e., since the number of driving lines for driving are minimized, so that the aperture ratio of the pixel may be improved. Further, the period in which the threshold voltage of the driving transistor M1 can be sufficiently secured even when the pixel 140 according to this embodiment is driven at a high frequency of 120 Hz or more, and accordingly, display quality may be improved. In addition, since the pixel 140 according to this embodiment maintains the static voltages of the first power ELVDD and the second power ELVSS during the frame period, power consumption and EMI may be reduced.

Figure 4:
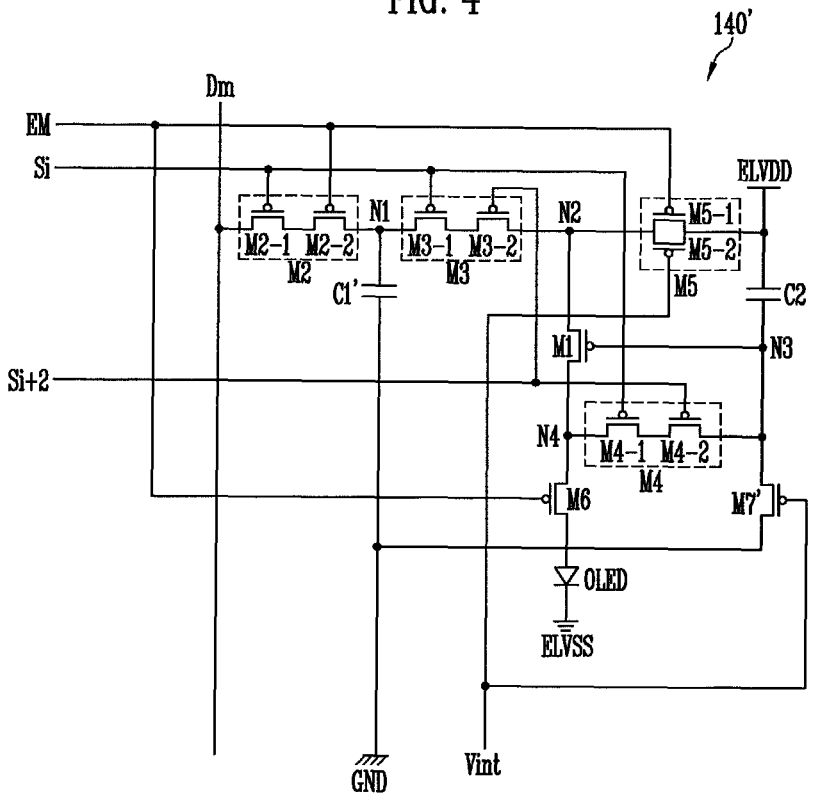
FIG. 4 is a circuit diagram illustrating a second embodiment of the pixel shown in FIG. 1.

FIG. 4 is a circuit diagram illustrating a second embodiment of a pixel shown in FIG. 1. In description of FIG. 4, detailed descriptions of components identical to those of FIG. 2 will be omitted.

Referring to FIG. 4, in the pixel 140' according to the second embodiment, a first capacitor C1' and a second electrode of a seventh transistor M7' may be coupled to a separate static voltage source, e.g., a ground power GND other than the initial power Vinit.

In this case, the first capacitor C1' supplies a voltage charged during the first period to the second capacitor C2 during the third period, without any change in voltage. Thus, the first capacitor C1' may have a higher capacitance than that of the first capacitor C1 in the first embodiment. The seventh transistor M7' initializes the third node N3 to the voltage of the static voltage source during the second period in which the initial power Vinit of the second voltage V2 is supplied. To this end, the static voltage source may have a voltage lower than that of the data signal. The rest of the operation process of the pixel 140' is identical to that of the pixel 140 according to the first embodiment, and therefore, its detailed description will be omitted.

Meanwhile, although it has been illustrated in FIG. 4 that the first capacitor C1' and the second electrode of the seventh transistor M7' are coupled to the static voltage source, the present embodiment is not limited thereto. For example, only one of the first capacitor C1' and the second electrode of the seventh transistor M7' may be coupled to the static voltage source.

Figure 5:
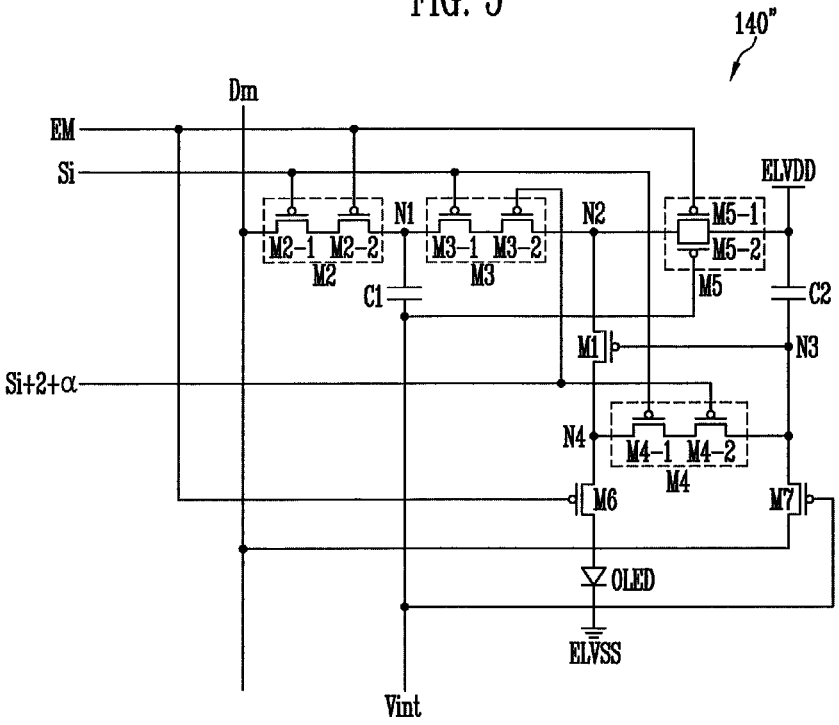
FIG. 5 is a circuit diagram illustrating a third embodiment of the pixel shown in FIG. 1.

FIG. 5 is a circuit diagram illustrating a third embodiment of the pixel shown in FIG. 1. In description of FIG. 5, detailed descriptions of components identical to those of FIG. 2 will be omitted.

Referring to FIG. 5, a next scan line Si+2+α (the α is a natural number of 1 or more) is set in the pixel 140" according to the third embodiment. That is, the next scan line Si+2+α may be selected as any one of scan lines posterior to the scan line Si+2. Specifically, the current scan line Si and the next scan line Si+2+α are used to turn on the third and fourth transistors M3 and M4 at the same time. Thus, the current scan line Si and the next scan line Si+2+α are used during the period in which the scan signal is simultaneously supplied to the scan lines S1 to Sn. Accordingly, the next scan line Si+2+α may be selected as any one of scan lines posterior to the scan line Si+2.

The rest of the operation process of the pixel 140" is identical to that of the pixel 140 according to the first embodiment, and therefore, its detailed description will be omitted.

By way of summary and review, in the pixel and the organic light emitting display device according to embodiments, the period in which the threshold voltage of the driving transistor can be sufficiently secured even when the pixel is driven at a high speed, improving display quality. Further, according to embodiments, the number of signal lines coupled to the pixels while the first power and the second power maintain a static voltage may be reduced, improving the aperture ratio of the pixel. Since the voltage of the first capacitor that previously charges the data signal is increased using the initial voltage, it is possible to minimize the capacitance of the first capacitor and to charge a desired voltage in the second capacitor. Finally, according to embodiments, since the static voltages are maintained during the frame period, power consumption and EMI may be reduced.

In contrast, when driving a driving transistor at a high speed, e.g., a driving frequency of over 120 Hz to eliminate a motion blur phenomenon, the period for charging the threshold voltage of the driving transistor is shortened, and conventional approaches cannot compensate for variations in the threshold voltage of the driving transistor.

Further, in conventional approaches to threshold voltage variation compensation, a plurality of driving signals are added to drive the compensation circuit added to each pixel, decreasing the aperture ratio of the pixel. One conventional approach to this decreased aperture ratio includes altering driving power (first power ELVDD and second power ELVSS) to simplify the structure of the pixel. However, when the driving power is changed, power consumption is increased, and much EMI occurs.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:

pixels at intersection portions of scan lines and data lines;

an emission control line commonly coupled to the pixels;

an initial power supply unit commonly coupled to a gate electrode of at least one transistor included in each of the pixels, the initial power supply unit supplying a first voltage during a first period, a second voltage lower than the first voltage during a second period, and a third voltage higher than the first voltage during a third period in one frame period;

a scan driver for driving the scan lines and the emission control line; and a data driver for driving the data lines.

2. The organic light emitting display device according to claim 1, wherein the first voltage is set to a voltage at which the at least one transistor in the pixel is turned off, and the second voltage is set to a voltage at which the at least one transistor in the pixel is turned on.

3. The organic light emitting display device according to claim 1, wherein:

the scan driver sequentially supplies a scan signal to the scan lines during the first period and simultaneously supplies a scan signal to the scan lines during the third period; and the scan driver supplies an emission control signal to the emission control line during the second and third periods, and not during the first period.

4. The organic light emitting display device according to claim 3, wherein the scan signal supplied during the third period has a width wider than that of the scan signal supplied during the first period.

5. The organic light emitting display device according to claim 4, wherein the scan signal supplied during the first period has a width of 2H or more.

6. The organic light emitting display device according to claim 3, wherein the scan signal is set to a turn-on voltage, and the emission control signal is set to a turn-off voltage.

7. The organic light emitting display device according to claim 3, wherein the scan driver supplies a scan signal supplied to an i-th (the i is a natural number) scan line and a scan signal supplied to an (i+1)-th scan line during the first period so that the scan signals overlap each other during a portion of the first period.

8. The organic light emitting display device according to claim 7, wherein the data driver supplies, to the data lines, a data signal corresponding to the scan signal supplied to the i-th scan line during the period in which the scan signal supplied to the i-th scan line and the scan signal supplied to the (i+1)-th scan line overlap each other.

9. The organic light emitting display device according to claim 3, wherein each of the pixels on an i-th (the i is a natural number) horizontal line comprises:

an organic light emitting diode;

a second transistor coupled between a data line and a first node, the second transistor controlling the coupling between the data line and the first node, corresponding to a scan signal supplied to a current scan line and an emission control signal supplied to the emission control line;

a third transistor coupled between the first node and a second node, the third transistor controlling the coupling between the first and second nodes, corresponding to the scan signal supplied to the current scan line and a scan signal supplied to a next scan line;

a second capacitor coupled between a third node and a first power;

a first transistor coupled between the second node and a fourth node, the first transistor having a gate electrode coupled to the third node so as to control the amount of current supplied to the organic light emitting diode;

a fourth transistor coupled between the third and fourth nodes, the fourth transistor being simultaneously turned on/off together with the third transistor; and a first capacitor having a first terminal coupled to the first node.

10. The organic light emitting display device according to claim 9, wherein the first capacitor has a higher capacitance than that of the second capacitor.

11. The organic light emitting display device according to claim 9, wherein the current scan line is an i-th scan line, and the next scan line is an (i+2+$\alpha$)-th (the $\alpha$ is 0, 1, 2, 3, . . . ) scan line.

12. The organic light emitting display device according to claim 9, wherein a second terminal of the first capacitor is coupled to the initial power supply unit.

13. The organic light emitting display device according to claim 9, wherein a second terminal of the first capacitor is coupled to a static voltage source.

14. The organic light emitting display device according to claim 9, wherein the second transistor includes two transistors coupled in series, gate electrode of the two transistors being coupled to the current scan line and the emission control line, respectively.

15. The organic light emitting display device according to claim 9, wherein the third transistor includes two transistors coupled in series, gate electrode of the two transistors being to the current scan line and the next scan line, respectively.

16. The organic light emitting display device according to claim 9, wherein the fourth transistor includes two transistors coupled in series, gate electrode of the two transistors being coupled to the current scan line and the next scan line, respectively.

17. The organic light emitting display device according to claim 9, wherein each of the pixels positioned on the i-th horizontal line further comprises:

a fifth transistor coupled between the second node and the first power, the fifth transistor controlling the coupling between the second node and the first power, corresponding to initial power supplied from the initial power supply unit and the emission control signal supplied to the emission control line; and a sixth transistor coupled between the fourth node and an anode electrode of the organic light emitting diode, the sixth transistor having a gate electrode coupled to the emission control line.

18. The organic light emitting display device according to claim 17, wherein the fifth transistor includes two transistors coupled in parallel, gate electrodes of the two transistors being coupled to the emission control line and the initial power supply unit, respectively.

19. The organic light emitting display device according to claim 17, wherein each of the pixels on the i-th horizontal line further comprises a seventh transistor coupled between the third node and the data line, the seventh transistor having a gate electrode coupled to the initial power supply unit.

20. The organic light emitting display device according to claim 17, wherein each of the pixels positioned on the i-th horizontal line further comprises a seventh transistor coupled between the third node and the static voltage source, the seventh transistor having a gate electrode coupled to the initial power supply unit.

21. The organic light emitting display device according to claim 20, wherein the static voltage source has a voltage lower than the data signal supplied to the data lines.

22. The organic light emitting display device according to claim 1, wherein the data driver supplies, to the data lines, the lowest voltage that the data driver is to supply during the second period.

23. A pixel, comprising:

an organic light emitting diode;

a second transistor having two transistors coupled in series between a data line and a first node, wherein gate electrodes of the two transistors are coupled to a current scan line and an emission control line, respectively;

a third transistor having two transistors coupled in series between the first node and a second node, wherein gate electrodes of the two transistors are coupled to the current scan line and a next scan line, respectively;

a second capacitor coupled between a third node and a first power;

a first transistor coupled between the second node and a fourth node, the first transistor having a gate electrode coupled to the third node so as to control the amount of current supplied to the organic light emitting diode;

a fourth transistor having two transistors coupled in series between the third and fourth nodes, wherein gate electrodes of the two transistors are coupled to the current scan line and the next scan line, respectively; and a first capacitor coupled between the first node and initial power.

24. The pixel according to claim 23, further comprising:

a fifth transistor having two transistors coupled in parallel between the second node and the first power, wherein gate electrodes of the two transistors are coupled to the emission control line and the initial power;

a sixth transistor coupled between the fourth node and an anode electrode of the organic light emitting diode, the sixth transistor having a gate electrode coupled to the emission control line; and a seventh transistor coupled between the third node and the data line, the seventh transistor having a gate electrode coupled to the initial power.

25. The pixel according to claim 23, further comprising:

a fifth transistor having two transistors coupled in parallel between the second node and the first power, wherein gate electrodes of the two transistors are coupled to the emission control line and the initial power;

a sixth transistor coupled between the fourth node and the anode electrode of the organic light emitting diode, the sixth transistor having a gate electrode coupled to the emission control line; and a seventh transistor coupled between the third node and a static voltage source, the seventh transistor having a gate electrode coupled to the initial power.

26. The pixel according to claim 25, wherein the static voltage source has a voltage lower than that of the data signal supplied to the data line.

* * * * *